US012408781B1

(12) United States Patent
Wang et al.

(10) Patent No.: US 12,408,781 B1
(45) Date of Patent: Sep. 9, 2025

(54) MULTIFUNCTIONAL RECHARGEABLE HEAT PRESERVATION LUNCH BOX

(71) Applicant: Shenzhen Zhimei Lianchuang Technology Co., LTD, Shenzhen (CN)

(72) Inventors: Xiaodong Wang, Nanchong (CN); Xiaojiang Tan, Chongqing (CN); Hu Peng, Bijie (CN)

(73) Assignee: Shenzhen Zhimei Lianchuang Technology Co., LTD, Shenzhen (CN)

( * ) Notice: Subject to any disclaimer, the term of this patent is extended or adjusted under 35 U.S.C. 154(b) by 0 days.

(21) Appl. No.: 19/023,238

(22) Filed: Jan. 15, 2025

(51) Int. Cl.

| | |
|---|---|
| ***A47G 23/04*** | (2006.01) |
| ***B65D 25/04*** | (2006.01) |
| ***B65D 25/20*** | (2006.01) |
| ***B65D 43/02*** | (2006.01) |
| ***B65D 51/24*** | (2006.01) |
| ***B65D 77/04*** | (2006.01) |
| ***B65D 81/34*** | (2006.01) |
| ***B65D 81/38*** | (2006.01) |

(52) U.S. Cl.
CPC ..... *A47G 23/04* (2013.01); *B65D 25/04* (2013.01); *B65D 25/20* (2013.01); *B65D 43/0202* (2013.01); *B65D 51/242* (2013.01); *B65D 51/247* (2013.01); *B65D 77/046* (2013.01); *B65D 81/3476* (2013.01); *B65D 81/3825* (2013.01); *B65D 2543/00194* (2013.01)

(58) Field of Classification Search
CPC ..... A45C 11/20; A47J 47/14; A47G 23/04
USPC ..... 220/521
See application file for complete search history.

(56) References Cited

U.S. PATENT DOCUMENTS

| | | | | |
|---|---|---|---|---|
| 5,174,452 | A * | 12/1992 | Wang | A45C 11/20 206/542 |
| 5,235,822 | A * | 8/1993 | Leonovich, Jr. | A45C 11/20 455/344 |
| 6,129,235 | A * | 10/2000 | Creske | A47G 19/065 220/737 |
| 2021/0161328 | A1* | 6/2021 | Piernikosch | H05B 1/0252 |
| 2021/0345743 | A1* | 11/2021 | Ribeiro Ruiz | A47J 36/32 |
| 2023/0180951 | A1* | 6/2023 | Ellison | B65D 81/3841 220/592.27 |

FOREIGN PATENT DOCUMENTS

| | | |
|---|---|---|
| CN | 210329685 U | 4/2020 |
| CN | 216165749 U | 4/2022 |
| CN | 220140999 U | 12/2023 |

* cited by examiner

*Primary Examiner* — Jeffrey R Allen
(74) *Attorney, Agent, or Firm* — Nitin Kaushik

(57) ABSTRACT

The present invention provides a multifunctional rechargeable heat preservation lunch box, including an inner box, an outer box, a rice basin, and an upper cover, where the inner box is fixed on the outer box, the rice basin is placed in the inner box, and the upper cover and the inner box are detachably mounted; a battery is arranged at the bottom of the outer box, a waterproof display screen, a PCBA, and a waterproof sealing cover are mounted on a side edge of the outer box, a heating plate and a heat insulation sheet are mounted at the bottom of the inner box, and the PCBA is electrically connected to the display screen, the heating plate, and the battery. According to the present invention, a plurality of problems existing in a traditional heat preservation lunch box are solved.

8 Claims, 6 Drawing Sheets

MULTIFUNCTIONAL RECHARGEABLE HEAT PRESERVATION LUNCH BOX

TECHNICAL FIELD

The present invention relates to the technical field of daily supplies, and in particular, to a multifunctional rechargeable heat preservation lunch box.

BACKGROUND

As the pace of modern life accelerates, more and more people choose to take meals to work, school, farming and fishing, etc., to save time and cost, so as to ensure a healthy diet. However, in this process, how to keep the freshness and temperature of the meals becomes an important issue. A traditional heat preservation lunch boxes mainly relies on a double-layer stainless steel structure to isolate an external environment, so as to achieve a certain heat preservation effect. However, there are some obvious limitations of this method: firstly, the heat preservation time is limited, especially in cold winter; secondly, the cooled food cannot be heated; and lastly, most traditional heat preservation lunch boxes lack an intelligent management function, which makes it difficult for a user to grasp an exact temperature state of the food.

In recent years, some portable lunch box products with an electric heating function have emerged in the market in an attempt to solve these problems. However, these products often have the following shortcomings:

Weak battery life: due to the limitation of the capacity of a built-in battery, the heating time is relatively short, and it is not suitable for long-time outdoor use.

Low safety: the waterproof performance is poor, and it is easy to cause circuit damage or even safety accidents due to water ingress.

With few functions, it has only simple heating and heat preservation functions.

In view of the foregoing problems, it is particularly important to develop a new type of multifunctional rechargeable heat preservation lunch box that combines efficient heat preservation, convenient operation and good safety.

SUMMARY

The present invention provides a multifunctional rechargeable heat preservation lunch box integrated with an electric heating system, aiming to overcome defects of an existing product and meet a requirement of a consumer for a high-quality catering experience.

The present invention includes an inner box, an outer box, a rice basin, and an upper cover, where the inner box is fixed on the outer box, the rice basin is placed in inner box, and the upper cover and the inner box are detachably mounted. A battery is arranged at the bottom of the outer box, a waterproof display screen, a PCBA, and a waterproof sealing cover are mounted on a side edge of the outer box, a heating plate and a heat insulation sheet are mounted at the bottom of the inner box, the PCBA is electrically connected to the display screen, the heating plate, and the battery, and the PCBA is provided with a charging port and a discharge port.

In further description of the foregoing solution, buckles are arranged on two sides of the upper cover, and clamping blocks matched with the buckles are arranged on two sides of the top of the inner box, so that the upper cover and the inner box are mounted in a sealed manner.

Preferably, a rotatable handle is further arranged at the top of the upper cover, and the handle can be accommodated in a groove of the upper cover.

Preferably, the top of the upper cover is recessed to form a storage compartment, a compartment cover is further arranged on the storage compartment, and the storage compartment is provided with a spoon, chopsticks, and a fork. A rice basin cover is further arranged above the rice basin, which not only improves the heat preservation effect, but also facilitates cleaning of the upper cover.

Further, the bottom of the inner box is arranged in a penetrating manner and is block by a bottom plate and a first sealing ring; and the heating plate is mounted below the bottom plate, and the heat insulation sheet and an inner box bottom plate are sequentially arranged below the heating plate. Several temperature sensors are arranged on the inner box, and the temperature sensors are electrically connected to the PCBA, so that the temperature of the inner box is monitored.

Further, the bottom of the outer box is recessed to form a battery compartment, the battery is mounted in the battery compartment, a second sealing ring and an outer box bottom cover are arranged at the bottom of the battery compartment, and an anti-slip gasket is further arranged at the bottom of the outer box.

Optionally, the rice basin 5 is divided into a staple food compartment, a dish compartment, and a soup compartment.

Compared with the prior art, according to the present invention, through a built-in large-capacity battery and a heating plate, the functions of long-time heat preservation and rapid food heating can be achieved, and it is ensured that hot meals can be enjoyed even without a power supply;

- intelligent temperature control: a microprocessor is integrated on the PCBA, and several temperature sensors of the inner box are arranged, so that an operating state of the heating plate can be automatically adjusted according to a preset temperature, and meanwhile, the display screen displays a current temperature in real time, so that a user can visually know a temperature condition in the lunch box, which facilitates timely adjustment, and in addition, the lunch box will be safer under the monitoring of the temperature sensor;
- highly sealed and waterproof design: the first sealing ring and the second sealing ring are matched with the outer box bottom cover and the waterproof sealing cover, so that moisture is effectively prevented from entering an internal circuit area, and the durability and safety of the product are improved; and
- diversified application scenario: whether an office worker, a student or an outdoor enthusiast can use the heat preservation lunch box to enjoy delicious and healthy food, and in addition, the lunch box has a mobile power supply function, which is very suitable for an outdoor enthusiast.

In summary, according to the present invention, a plurality of problems existing in a traditional heat preservation lunch box are solved, and the functionality, safety, user experience and the like are significantly improved. The lunch box has a relatively high market promotion value and social benefits.

BRIEF DESCRIPTION OF THE DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and those of ordinary skill in the art may still derive other accompanying drawings from these accompanying drawings without creative efforts.

Figure 1:
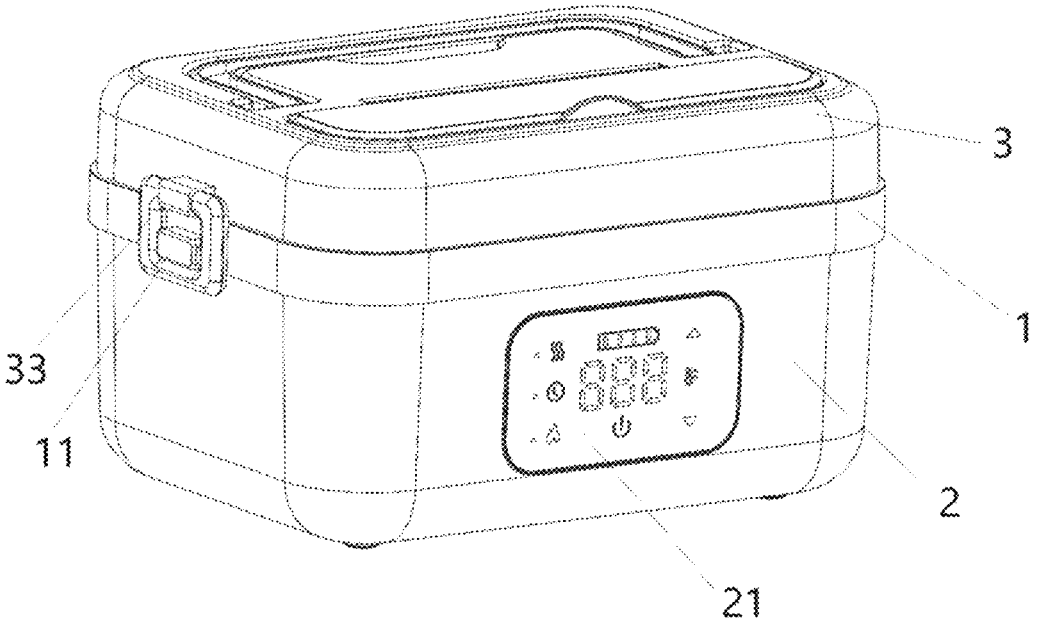
FIG. 1 and FIG. 2 are an overall schematic diagrams provided by embodiments of the present invention.

Herein, Reference Numerals in the Drawings:

1. inner box; 11. clamping block; 12. bottom plate; 13. first sealing ring; 2. outer box; 21. display screen; 22. battery; 23. PCBA; 24. waterproof sealing cover; 25. second sealing ring; 26. outer box bottom cover; 27. gasket; 3. upper cover; 31. handle; 32. storage compartment; 321. compartment cover; 33. buckle; 34. rice basin cover; 4. heating plate; 41. heat insulation sheet; 42. inner box bottom plate; 5. rice basin.

Through the above drawings, clear embodiments of the present invention have been shown, which will be described in more detail in the following text. These drawings and textual descriptions are not intended to limit the scope of the inventive concept in any way, but rather to illustrate the concept of the present invention for those skilled in the art by referring to specific embodiments.

DETAILED DESCRIPTION OF THE EMBODIMENTS

The following clearly and completely describes the technical solutions in the embodiments of the present invention with reference to the accompanying drawings in the embodiments of the present invention. Apparently, the described embodiments are some but not all of the embodiments of the present invention. Based on the embodiments in the present invention, all other embodiments obtained by those of ordinary skill in the art without making creative labor fall within the scope of protection of the present invention.

To make the technical solutions and advantages of the present invention clearer, the following further describes the embodiments of the present invention in detail with reference to the accompanying drawings.

Referring to FIG. 1 to FIG. 6, the present invention includes an inner box 1, an outer box 2, a rice basin 5, and an upper cover 3, where the inner box 1 is fixed on the outer box 2, the rice basin 5 is placed in inner box 1, and the upper cover 3 and the inner box 1 are detachably mounted. A battery 22 is arranged at the bottom of the outer box 2, a waterproof display screen 21, a PCBA 23, and a waterproof sealing cover 24 are mounted on a side edge of the outer box 2, a heating plate 4 and a heat insulation sheet 41 are mounted at the bottom of the inner box 1, the PCBA 23 is electrically connected to the display screen 21, the heating plate 4, and the battery 22, and the PCBA 23 is provided with a charging port and a discharge port.

In this embodiment, buckles 33 are arranged on two sides of the upper cover 3, and clamping blocks 11 matched with the buckles 33 are arranged on two sides of the top of the inner box 1, so that the upper cover 3 and the inner box 1 are mounted in a sealed manner. Through this arrangement, the upper cover 3 can be disengaged from the inner box 1, so that cleaning and use are more convenient. It should be noted that the upper cover 3 and the inner box 1 are further arranged in a flip type and push-pull mode.

In this embodiment, a rotatable handle 31 is further arranged at the top of the upper cover 3, and the handle 31 can be accommodated in a groove of the upper cover 3. The top of the upper cover 3 is recessed to form a storage compartment 32, a compartment cover 321 is further arranged on the storage compartment 32, and the storage compartment 32 is provided with a spoon, chopsticks, and a fork. A rice basin cover 34 is further arranged above the rice basin 5, which not only improves the heat preservation effect, but also facilitates cleaning of the upper cover 3.

In this embodiment, the bottom of the inner box 1 is arranged in a penetrating manner and is block by a bottom plate 12 and a first sealing ring 13. According to the solution, an existing inner box 1 is redesigned, materials of the existing inner box 1 are the same, however, in this embodiment, the bottom of the inner box 1 is hollowed out, and other materials are used for blocking, so that the heat preservation performance and the safety performance are improved. The inner box 1 can be made of glass, the bottom of the inner box can be made of a metal material, which has a good heat conduction capacity.

The heating plate 4 is mounted below the bottom plate 12, and the heat insulation sheet 41 and an inner box bottom plate 42 are sequentially arranged below the heating plate 4. Several temperature sensors are arranged on the inner box 1, and the temperature sensors are electrically connected to the PCBA 23, so that the temperature of the inner box 1 is monitored, and it is convenient for a user to select different temperatures.

Figure 2:
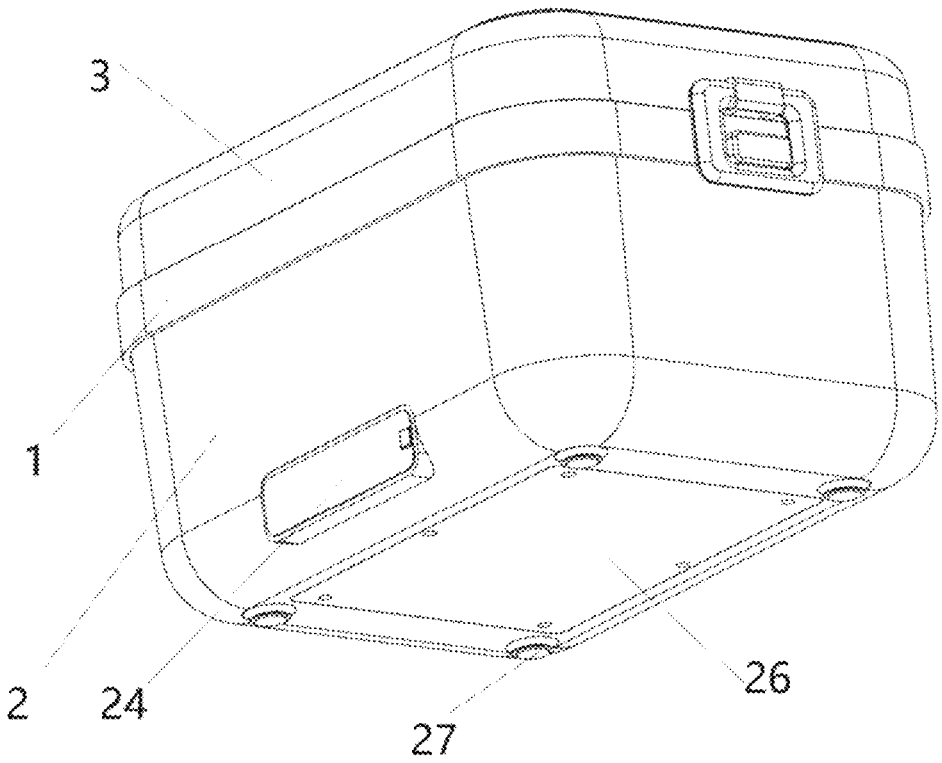
Figure 3:
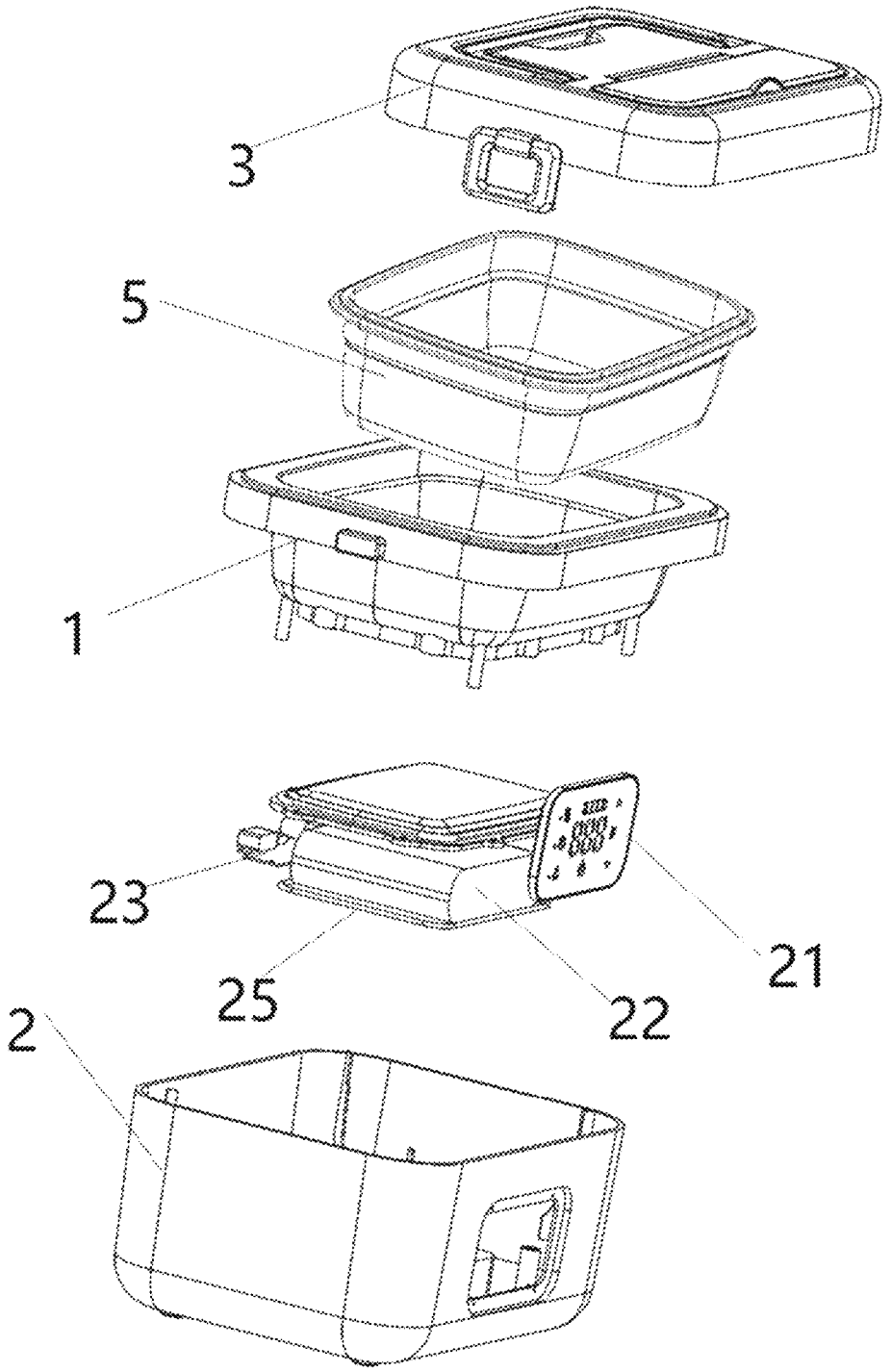
FIG. 3 is an exploded schematic diagram provided by embodiments of the present invention.
Figure 4:
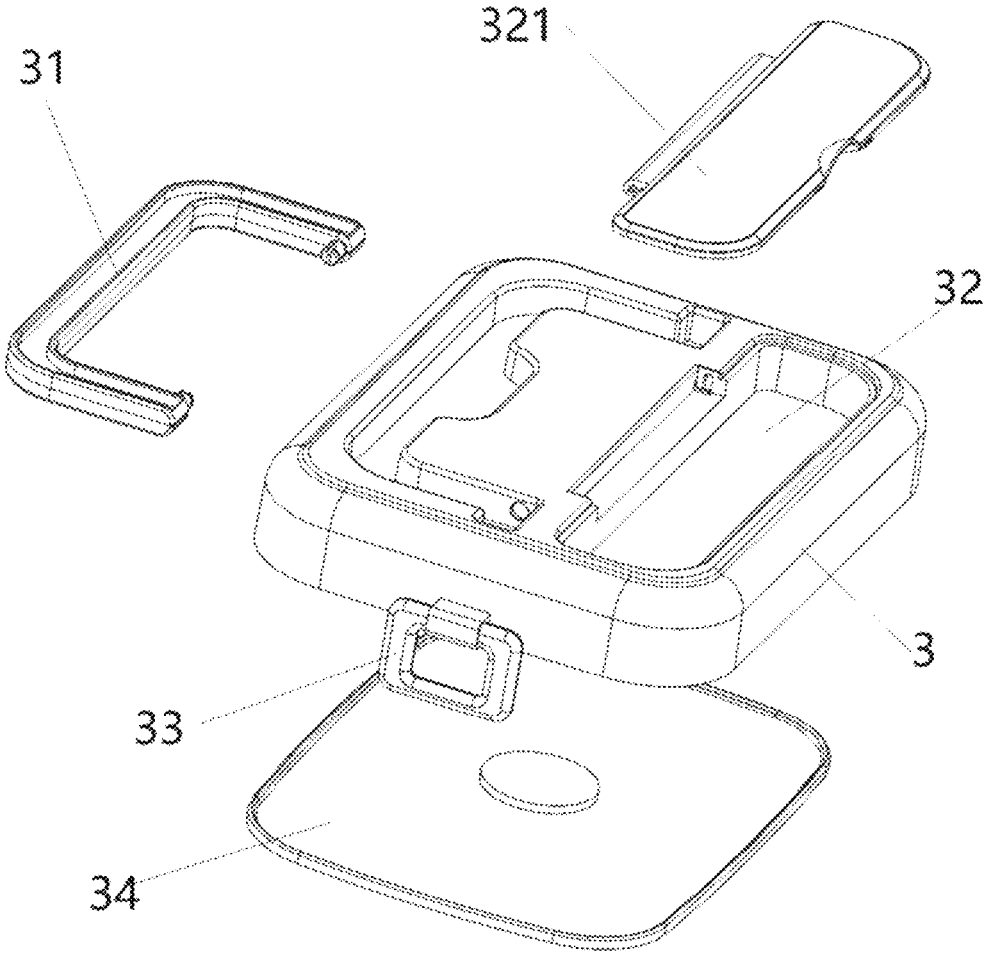
FIG. 4 is an exploded schematic diagram of an upper cover provided by embodiments of the present invention.
Figure 5:
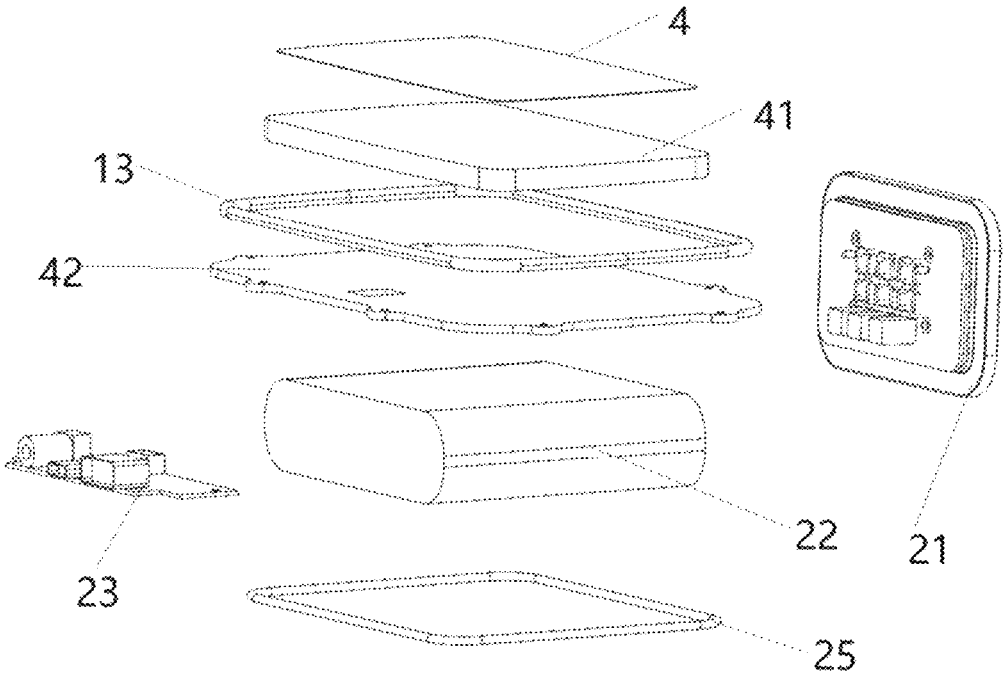
FIG. 5 is an exploded schematic diagram of a heating device and a circuit provided by embodiments of the present invention.
Figure 6:
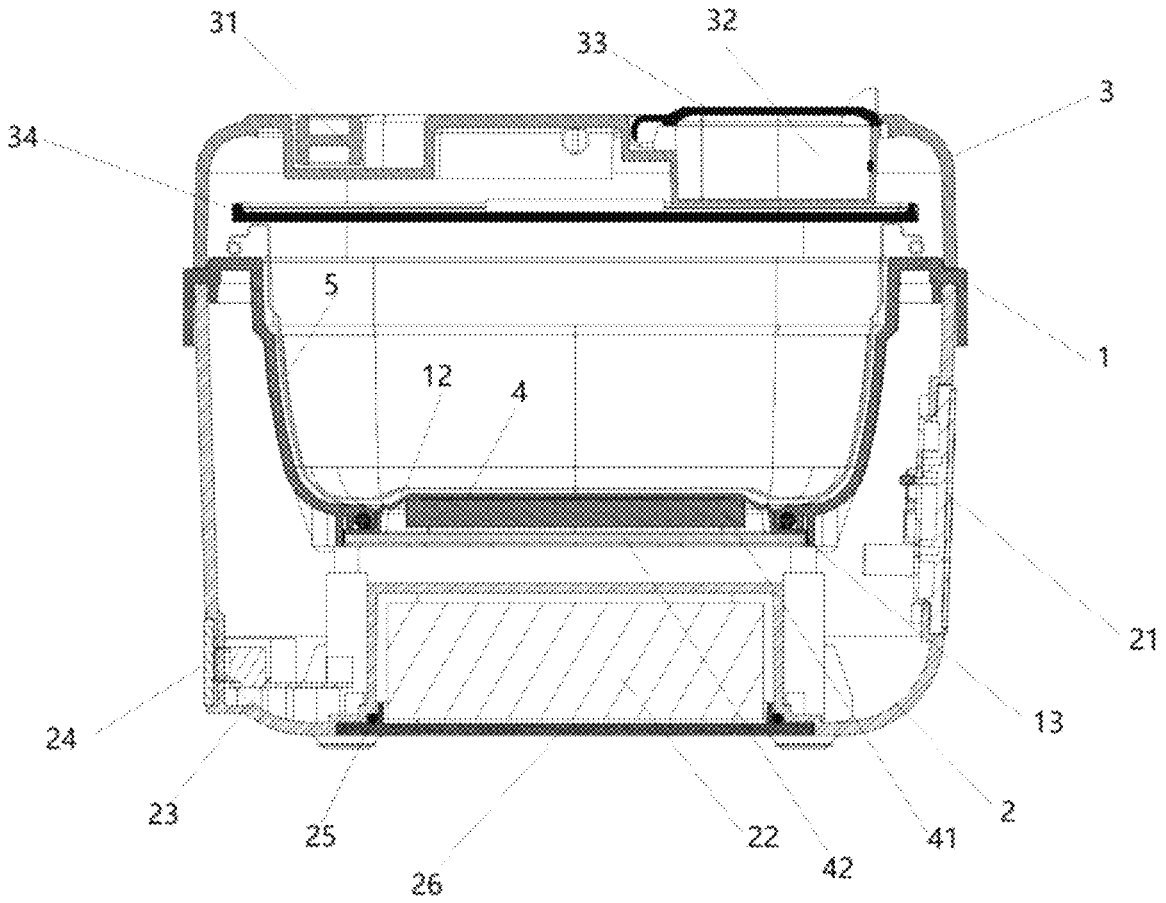
FIG. 6 is an overall sectional view provided by embodiments of the present invention.

As shown in FIG. 2 and FIG. 6, the bottom of the outer box 2 is recessed to form a battery compartment, the battery 22 is mounted in the battery compartment, a second sealing ring 25 and an outer box bottom cover 26 are arranged at the bottom of the battery compartment, and an anti-slip gasket 27 is further arranged at the bottom of the outer box 2.

In other embodiments, the rice basin 5 is divided into a staple food compartment, a dish compartment, and a soup compartment.

In order to understand the disclosure of the present invention more thoroughly and comprehensively, the principle of the lunch box is further explained below in conjunction with the use manner.

In actual use, the waterproof sealing cover 24 is firstly opened to fully charge the battery 22, the power can be seen from the display screen 21, and the user can be actively reminded to charge through the display screen 21 when the power is insufficient. The meals are placed into the rice basin 5, the rice basin cover 34 covers the rice basin 5, and then the upper cover 3 is buckled at the top of the inner box 1. The power button of the display screen 21 is long pressed, and the heat preservation time and the heat preservation temperature are set on the display screen 21. After the heat preservation function is started, the temperature sensor monitors in real time and feeds back data to a microprocessor on the PCBA 23, and the microprocessor heats the heating disk according to the situation. When the user needs to charge an electronic device such as a mobile phone and a tablet computer, the user can directly open the waterproof sealing cover 24 and then charges the electronic device through the data cable.

It should be noted that water can be added to the inner box 1, in the heating process, water between the inner box 1 and the rice basin 5 is heated to form water vapor, and the water vapor wraps the rice basin 5 to heat the meals, so as to achieve a dual heating effect.

After considering the specification and practicing the present invention, those skilled in the art will easily come up with other embodiments of the present invention. The present application is intended to cover any variations, uses, or adaptations of the present invention that follow the general principles of the present invention and include common knowledge or customary technical means in the art that are not disclosed in the present invention. The specification and embodiments are only considered exemplary, and the true scope and spirit of the present invention are indicated by the following claims.

It should be noted that, when an element is described to be "fixed to" another element, it may be directly positioned on another element or there may be a centered element. When an element is described to be "connected to" another element, it may be directly connected to another element or there may additionally be a centered element. On the contrary, when an element is referred to as "being directly on" another element, there is no intermediate element. The terms "vertical", "horizontal", "left", "right" and similar expressions are used for illustrative purposes only and not intended to be expressed as the only embodiment. The terms "upper end", "lower end", "left side", "right side", "front end", "back end" and similar expressions used herein are based on the positional relationship of the reference drawings.

It should be understood that the present invention is not limited to the precise structure described above and shown in the accompanying drawings, and various modifications and changes can be made without departing from its scope. The scope of the present invention is limited to the appended claims.

What is claimed is:

1. A multifunctional rechargeable heat preservation lunch box, comprising an inner box (1), an outer box (2), a rice basin (5), and an upper cover (3), wherein the inner box (1) is fixed on the outer box (2), the rice basin (5) is placed in the inner box (1), and the upper cover (3) and the inner box (1) are detachably mounted; a battery (22) is arranged at the bottom of the outer box (2), a waterproof display screen (21), a PCBA (23), and a waterproof sealing cover (24) are mounted on a side edge of the outer box (2), a heating plate (4) and a heat insulation sheet (41) are mounted at the bottom of the inner box (1), and the PCBA (23) is electrically connected to the display screen (21), the heating plate (4), and the battery (22); and wherein the bottom of the inner box (1) is arranged in a penetrating manner and is block by a bottom plate (12) and a first sealing ring (13); the heating plate (4) is mounted below the bottom plate (12), and the heat insulation sheet (41) and an inner box bottom plate (42) are sequentially arranged below the heating plate (4); and several temperature sensors are arranged on the inner box (1), and the temperature sensors are electrically connected to the PCBA (23).

2. The multifunctional rechargeable heat preservation lunch box according to claim 1, wherein buckles (33) are arranged on two sides of the upper cover (3), and clamping blocks (11) matched with the buckles (33) are arranged on two sides of the top of the inner box (1).

3. The multifunctional rechargeable heat preservation lunch box according to claim 1, wherein a rotatable handle (31) is further arranged at the top of the upper cover (3), and the handle (31) can be accommodated in a groove of the upper cover (3).

4. The multifunctional rechargeable heat preservation lunch box according to claim 1, wherein the top of the upper cover (3) is recessed to form a storage compartment (32), and a compartment cover (321) is further arranged on the storage compartment (32); and a rice basin cover (5) is further arranged above the rice basin (34).

5. The multifunctional rechargeable heat preservation lunch box according to claim 1, wherein the bottom of the outer box (2) is recessed to form a battery compartment, the battery (22) is mounted in the battery compartment, a second sealing ring (25) and an outer box bottom cover (26) are arranged at the bottom of the battery compartment, and an anti-slip gasket (27) is further arranged at the bottom of the outer box (2).

6. The multifunctional rechargeable heat preservation lunch box according to claim 1, wherein the rice basin (5) is divided into a staple food compartment, a dish compartment, and a soup compartment.

7. The multifunctional rechargeable heat preservation lunch box according to claim 4, wherein the storage compartment (32) is provided with a spoon, chopsticks and a fork.

8. The multifunctional rechargeable heat preservation lunch box according to claim 1, wherein the PCBA (23) is provided with a charging port and a discharge port.

* * * * *